United States Patent [19]

Brovman

[11] Patent Number: 4,656,941

[45] Date of Patent: Apr. 14, 1987

[54] PRESS PRESETTING METHOD

[75] Inventor: Yakoy Z. Brovman, Mystic, Conn.

[73] Assignee: Harris Graphics Corporation, Westerly, R.I.

[21] Appl. No.: 659,980

[22] Filed: Oct. 12, 1984

Related U.S. Application Data

[63] Continuation of Ser. No. 51,930, Jun. 25, 1979, abandoned.

[51] Int. Cl.[4] ..... B41F 31/04; B41F 33/16

[52] U.S. Cl. ..... 101/426; 101/365; 101/DIG. 26

[58] Field of Search ..... 101/365, 350, 148, 426, 101/349, DIG. 24, DIG. 26; 250/559, 571; 356/444, 443

[56] References Cited

U.S. PATENT DOCUMENTS

| | | | |
|---|---|---|---|
| 3,930,447 | 1/1976 | Murray | 101/365 |
| 3,958,509 | 5/1976 | Murray et al. | 101/350 |
| 4,180,741 | 12/1979 | Palmatier et al. | 250/559 |
| 4,187,435 | 2/1980 | Palmatier et al. | 250/559 |
| 4,210,818 | 7/1980 | Green et al. | 356/444 X |

OTHER PUBLICATIONS

Mavo—A System for Reducing the Setting-Up Times and Periods of Disuse of Roller Offset Machines, *Der Polygraph 22-75,* pp. 1393-1400, published 1975.

Printamat—An Automated System for Rotary Printing Presses, Bernahard Angerer, Bodo Kastel and Manfred Rubruck, *Der Polygraph,* pp. 489-492, published Aug. 1977.

*Primary Examiner*—J. Reed Fisher

*Attorney, Agent, or Firm*—Biebel, French & Nauman

[57] ABSTRACT

A method of automatic control of a printing press (10) comprising the steps of scanning a representation of an image to be printed by means of a light table (70) to derive therefrom objective data representing the average density of the inked image in areas corresponding to those controlled by keys (48) of an ink fountain, producing multiple printed copies (85) of the image as a result of subjective operator (80) intervention in the setting of the fountain keys, recording the objective data in memory (75) and subjective data representing the setting of the fountain keys as set by the operator in memory (90) for a plurality of different press runs, analyzing both the objective data and the key setting data by examining a plurality of harmonic components thereof sufficiently large to represent accurately that data by circuit means (100), correlating by a linear regression analysis respective harmonic components of the objective data and subjective data over said plurality of press runs and storing said linear regression parameters, thereafter scanning a representation of a new image to be printed by light table (70) to derive objective data therefrom, analyzing the new objective data by examining its harmonic components in circuit means (100) and by applying the regression parameter data for each previously found harmonic values, deriving therefrom key setting instructions for presetting the press (10).

1 Claim, 9 Drawing Figures

PRESS PRESETTING METHOD

This is a continuation of application Ser. No. 051,930, filed June 25, 1979, now abandoned.

BACKGROUND OF THE INVENTION

This invention relates to a method for presetting a machine, such as a printing press, which produces multiple copies of a product which are judged as to acceptability at least in part by subjective operator evaluation.

This invention has application to any machine or process wherein an objective standard may be used initially in presetting the machine, and wherein the machine output can thereafter be varied or adjusted in accordance with a subjective determination by its operator.

A typical example is in the setting of each of the ink fountains on a printing press. Each fountain is provided with a plurality of keys all of which are adjusted prior to printing to meter the amount of ink flowing onto the printing plate. In manually operated presses, the pressman will first scan visually the printing plate and estimate the amount of ink needed within each of the sections controlled by the keys of the ink fountain. There are other systems, wherein an optical scanner is used to scan a printing plate to determine the amount of ink needed within certain narrow sections of the printing plate, and that information is then processed to set automatically the corresponding keys of each fountain.

Many modern day presses are provided with electromechanical means for setting the keys from a remote location, and also transducers for indicating each key position at a remote location, for example, on a television screen. Also, means may be provided to record the information from the optical scanner regarding the percentage of coverage on the printing plate for each key position. Key position and other press information deemed by the pressman to represent the best printing quality is recorded so that if the printing run were interrupted, for whatever reason, that information could then be recalled and used to preset the machine when printing is resumed using those same plates.

Previously, the keys of the fountain were preset either according to the judgment of the pressman or by automatic means as described above. Once these initial adjustments were made, the press was then started, and further adjustments made to the fountains, and other systems, such as to compensate for registration of various colors, water fountains, etc., to improve the quality of the output until it achieved acceptable quality, known as "save" quality. As the press continued to run, still further fine adjustments were made by the pressman until, usually after several hours of running, a quality of printing of high grade results, known as "OK" quality. It is the "OK" quality settings that are recorded for later use should the printing operation be interrupted, for example by a priority printing job, during the middle of a run.

It is the purpose of this invention to utilize the pressman's previous subjective judgments as a means for modifying the objective information obtained from the optical scanning of a print plate to generate key setting information which will result in acceptable quality printing as early in the press run as possible.

SUMMARY OF THE INVENTION

In this invention, information from a plurality of previously completed jobs, including data obtained from an objective source and data obtained from a subjective source, are analyzed and compared to provide parameters which thereafter are used in setting machine functions in response to subsequently obtained objective data.

Specifically, the objective data, such as the amount of coverage as determined by the optical scanner, for each of the elements to be controlled, such as keys, is analyzed mathematically, and a Fourier analysis is made to derive amplitude information for a plurality of harmonics sufficient to represent accurately the relationship between the objective data and the element to be controlled.

Similarly, the subjective data, such as setting as determined by the pressman for the "OK" condition, for each of the machine elements to be controlled, such as keys, is also analyzed mathematically and represented by a plurality of amplitude values for a sufficient number of harmonics to represent accurately the above mentioned relationship.

This analysis is accomplished for a number of previous jobs on a particular machine, preferably with the same operator, sufficiently large that the information derived from this analysis is statistically valid.

In presetting the ink fountains of printing presses, it has been found that an analysis of only the first four harmonics of the above information will provide accurate information. Preferably, the average or zero harmonic is taken, and the sine and cosine functions of the first, second, third and fourth harmonics analyzed.

For each of the above nine analyses, derived from a Fourier analysis of each of the waveforms for the objective data and the subjective data, i.e., the percent coverage versus key number and key setting versus key number representations, an amplitude value is obtained. Therefore, for each of the nine analyses, for each job, there will be a single point representing the relationship between objective data (percent coverage) and subjective data (key setting). The data points for all jobs for each of the nine analyses are then plotted, and both the slope and the offset of these relationships are found by the least squares method. This information is then used to predict the key settings likely to be made by an operator on a particular press when a new set of objectively derived data is obtained.

It is therefore an object of the invention to provide a method of automatic control of a printing press comprising the steps of scanning a representation of an image to be printed to derive therefrom objective data representing the average density of the inked image in areas corresponding to those controlled by keys of an ink fountain, producing multiple printed copies of the image as a result of subjective operator intervention in the setting of the fountain keys, recording both the objective data and subjective data representing the setting of the fountain keys as set by the operator for a plurality of didferent press runs, analyzing both the objective data and the key setting data by examining a plurality of harmonic components thereof sufficiently large to represent accurately that data, correlating by a linear regression analysis respective harmonic components of the objective data and subjective data over said plurality of press runs and storing said linear regression parameters for later use, thereafter scanning a representation of a new image to to be printed to derive objective data therefrom, analyzing the new objective data by examining its harmonic components, and by applying the regression parameters data for each previously found harmonic values, deriving therefrom key setting instructions for presetting the press.

Other objects and advantages of the invention will be apparent from the following description, the accompanying drawings and the appended claims.

DESCRIPTION OF THE PREFERRED EMBODIMENT

Figure 1:
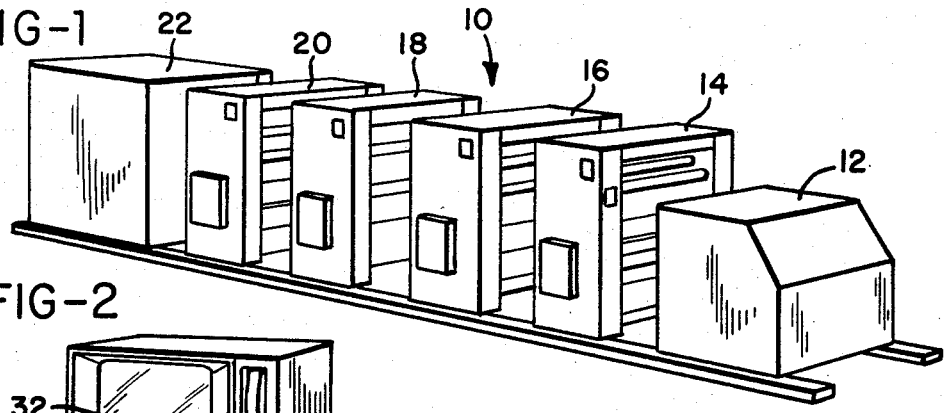
FIG. 1 is a perspective view illustrating a typical press in which this invention may be used.

Referring now to the drawings which illustrate a preferred embodiment of the invention, and particularly to FIG. 1, a typical press 10 includes a supply cabinet 12, press stations 14, 16, 18 and 20, and a dryer section 22. While a multiple section printing press is illustrated, it is to be understood that this invention is applicable to other types of machines wherein objectively obtained data may be processed and thereafter modified by the machine operator to produce a result which is pleasing to the eye. It is also understood that the press shown in FIG. 1 contains multiple sections, and that each of the sections can be independently controlled or modified in accordance with the invention hereinafter described.

Figure 2:
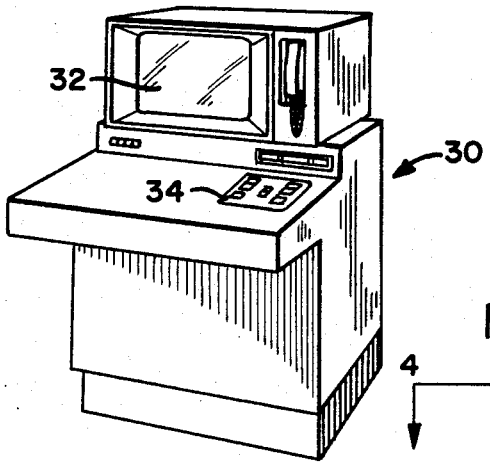
FIG. 2 represents a view of a control console for the press shown in FIG. 1.

FIG. 2 represents a control console 30 having a viewing screen 32 and a control panel 34. The position of the actuator keys on each of the fountain rolls of the press 10, for example, may be displayed visually on the screen 32, and those actuator positions varied according to the pressman's instructions by manipulation of the controls 34.

Figure 3:
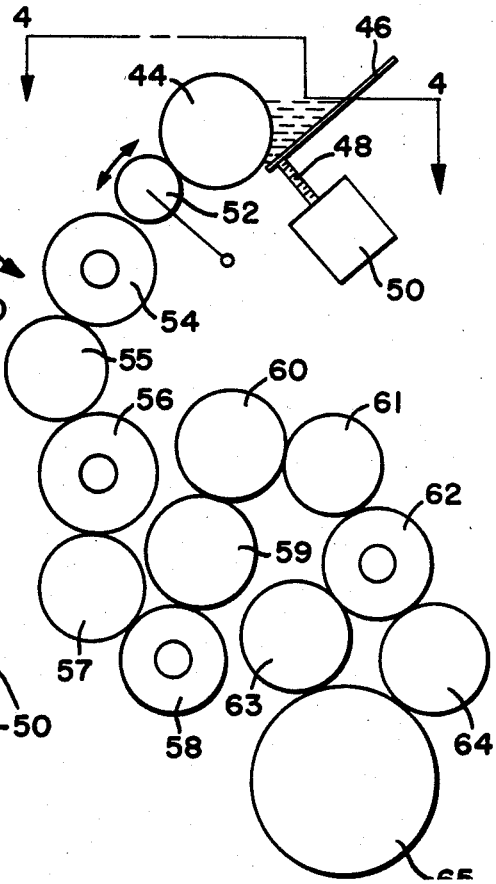
FIG. 3 illustrates a typical ink distribution system within the press.
Figure 4:
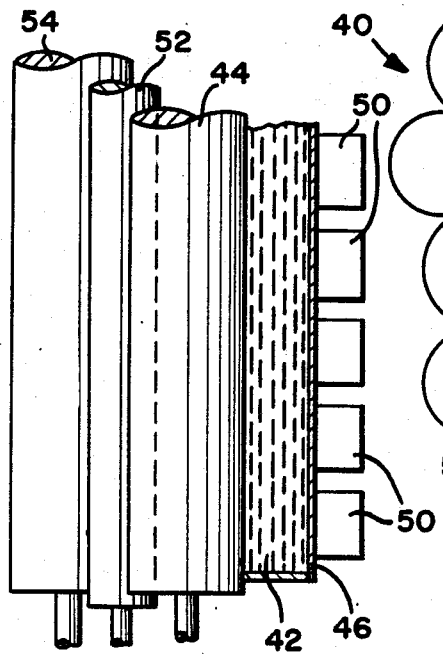
FIG. 4 is a view taken along 4—4 of FIG. 2 showing a detail of a portion of the ink distribution system.

FIG. 3 shows a typical ink distribution system 40 wherein ink is placed in a trough 42 formed between fountain roll 44 and the fountain blade 46. A plurality of keys 48 control the gap 49 between the blade 46 and the roll 44. The setting of the keys 48 is determined by actuators 50. In the example illustrated hereinafter, the press 10 has twelve fountains each including twenty-four keys.

A ductor roll 52 transfers the ink from the fountain roll 44 to an ink train including rolls 54–64 to the plate cylinder 64. Rolls 54, 56, 57, 59, 60 and 61 are distributor rolls; rolls 55, 58 and 62 are vibrator rolls, and rolls 63 and 64 are form rolls.

Figure 5:
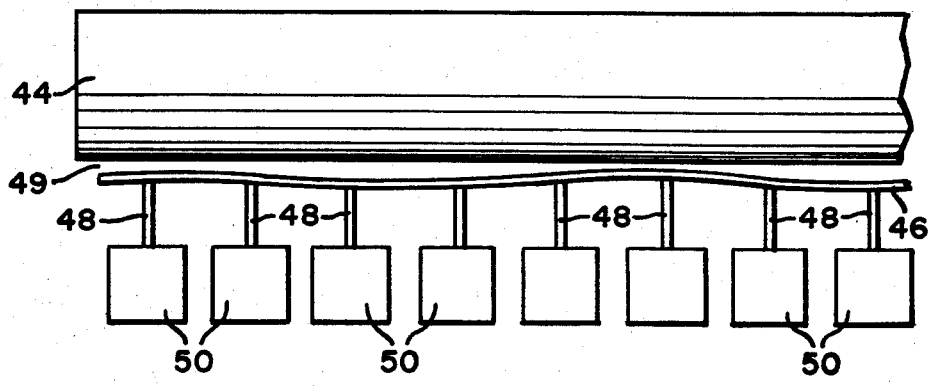
FIG. 5 is a view showing a portion of the fountain roll, the fountain blade, and the actuators which adjust the spacing between the blade and the fountain roll.

As illustrated in FIG. 5, the gap 49 between the blade 46 and the fountain roll 44 is determined by the setting of key 48. In FIG. 5, eight such keys are illustrated, with each key setting being determined by an actuator 50. The actuators may be controlled remotely from the console 30. Each actuator preferably includes a potentiometer or some other readout device so that the setting of the key 48 can be determined remotely, displayed on the screen 32 and recorded in a memory. The kety setting information, and therefore the gap between the blade 46 and the roll 44 is also used for other purposes, as will be explained. During initial set up of the press, the keys 48 are adjusted to place the blade 46 adjacent the roll 44. In a typical press, a three mil spacing will permit sufficient ink to be transmitted to provide for a fifteen percent ink coverage.

Figure 6:
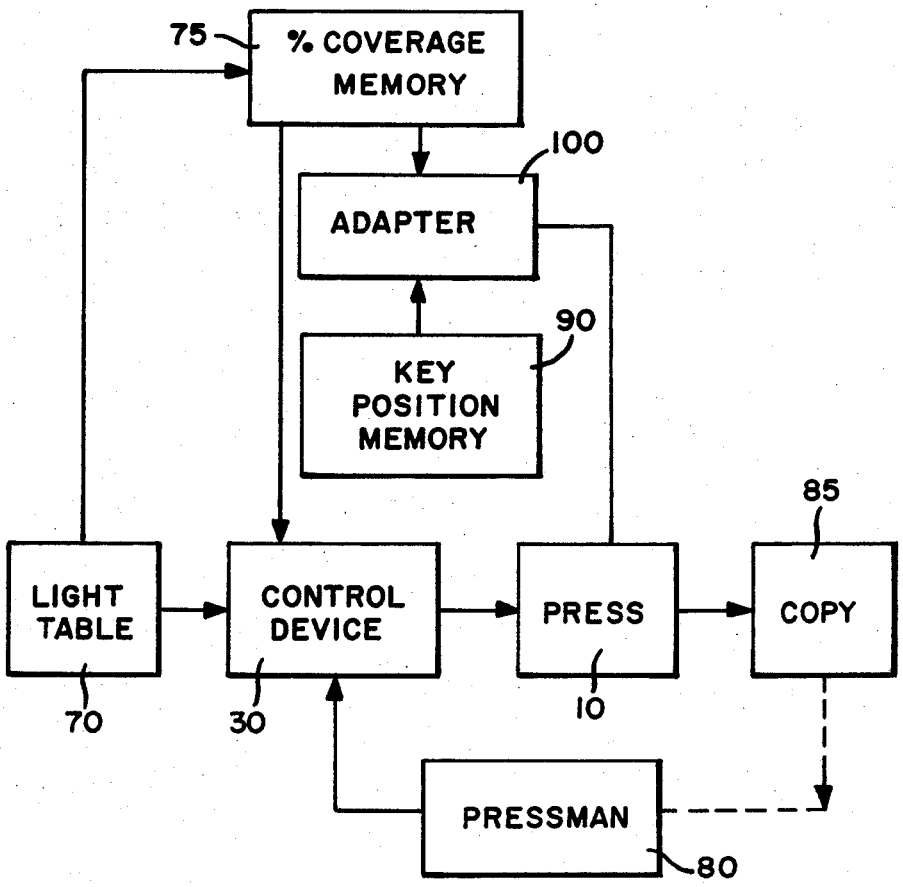
FIG. 6 is a simplified block diagram of a press illustrating the process normally followed in adjusting the press.

Turning now to FIG. 6, a light table 70 is a conventional device which is provided with a plurality of photosensitive elements for scanning the copy to be printed to determine the percentage of ink coverage in those areas corresponding to the areas controlled by the corresponding fountain keys. This data is an objective determination of the amount of ink needed for each key location across the plate cylinder and may be directed through the control console 30 to the press 10 and stored in a memory 75 and thereafter used in the manner hereinafter to be described.

It has been found through experience that a strictly linear correlation between the ink coverage values established by the light table 70 and the setting of the fountain keys 48 will not necessarily result in acceptable quality printing. This is due in part to the inability of the fountain blade 46 to depart radically from the spacing established by adjacent keys, the flexibility of the fountain blade itself, but mostly due to the action of the vibrator rolls 55, 58 and 62 in the ink train of FIG. 3. It has been discovered that adjustments to the keys 48 made by the pressman from a relatively smooth curve with respect to the fountain roll, and therefore a harmonic analysis of those settings would be valuable in predicting future key settings.

As illustrated in FIG. 6, an operator or pressman 80 visually observes the output of copy 85 from the machine or press 10 and judges the acceptability or quality of that output and then makes adjustments to the machine process, such as the setting of the fountain key, until the quality of the output is deemed satisfactory. In a multicolor press, for example, the amount as well as the distribution of the ink may be varied in small increments over a relatively long period of time before the highest quality output has been obtained.

Once the operator determines that further adjustments to the machine are unnecessary and that the highest quality output is being run, the adjustable machine settings are then recorded in a memory 90. That information will then be recalled and used to preset the machine at a later time should the printing run be interrupted for any reason.

Figure 7:
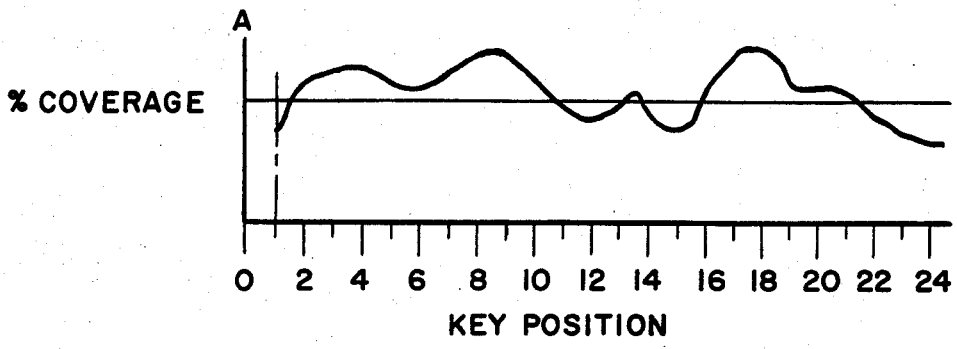
FIG. 7 is a chart showing the relationship between the average ink coverage on a given printing plate for each area controlled by a fountain key.

FIG. 7 shows the relationship between the fountain keys and the percentage of ink coverage for a particular printing operation. This represents objective data obtained by a properly calibrated optical instrument and is the information recorded in the memory 75 after the copy is scanned at the lgiht table 70.

Figure 8:
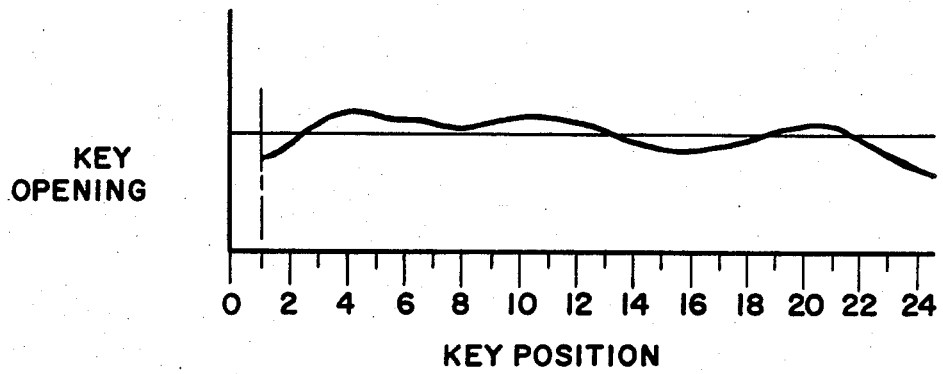
FIG. 8 is a chart showing the relationship between the setting of the fountain keys and the spacing between the blade and the fountain roll.

FIG. 8 shows the relationship betwen the fountain keys and the setting of those keys, or the gap between the fountain blade and the fountain roll. Typically, the resulting curve is smoothed because of the characteristics of the vibrator and the usual practice of the press operator. After the press has been run for some period of time, and several fine adjustments made to each fountain, and the operator is satisfied with the quality of the output, the setting of each key in each fountain are than recorded in the memory 90.

Both of the curves represented by FIGS. 7 and 8 are subjected to Fourier analysis. Since a typical press, and the one described herein, includes twenty-four key positions, twelve harmonics values may be analyzed; however, experience has shown that only the average and the first four harmonics need be analyzed to provide accurate key presetting instructions. A harmonic analysis has been found to approximate more closely the actions of the machine operator than a linear polynominal, or other type of analysis of the same information.

The first harmonic value appears to represent skewness, or the variations in spacing from one end of the rolls to the other within the ink train; the second harmonic appears to be a result of the pressman's personality, most of whom will close or substantially close the end keys; and other harmonics appear to be related to the state of the inker system—for example, irregularities in the rolls of the inking system of FIG. 3, such as humps and bumps.

The information stored in memories 75 and 90 for each of the fountains in a press (a typical press, and he one described hereinafter includes twelve fountains) for a plurality of printing jobs is correlated and the information obtained therefrom later used to preset the keys. By using the methods herein described for presetting the ink fountain keys, the quality of printing resulting from the press in ninety percent of the cases will be at least in the "save" category.

The number of jobs analyzed must be sufficiently large to provide a statistically accurate sample of the characteristics of the machine or press and represent the personality of characteristics and habits of the machine operator. It has been found that eight to ten press runs will provide sufficiently accurate information to preset the fountain keys as described.

Figure 9:
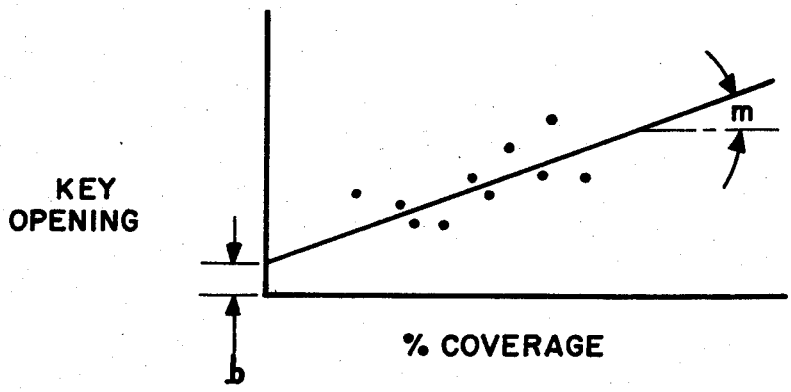
FIG. 9 is a diagram illustrating how the data obtained from a harmonic analysis of the charts of FIGS. 7 and 8 may be correlated for each harmonic component.

Nine different harmonic analyses will be made for each of the curves of FIGS. 7 and 8 for each of the fountains of the press. The average is first obtained, and this may be designated the "zero" harmonic. Then the curves are analyzed for the first four harmonic values of both the sine and cosine functions. As a result, a single amplitude value is obtained from each of the harmonic analysis for both of the curves, and this data is then analyzed for each of the plurality of jobs investigated as illustrated in FIG. 9. For example, the average value of FIG. 7 is compared with the average of FIG. 8, and that is plotted in FIG. 9 as represented by a single dot thereon. The zero harmonic for each of ten jobs, for example, will be plotted on the same way, resulting in the plurality of dots shown in FIG. 9. A line is drawn through these dots as determined by the least squares fit procedure, and this line therefore represents the correlation between the average or zero harmonic analysis of FIG. 7

Similarly, each of the remaining harmonic values for both the objective data of FIG. 7 and the subjective data of FIG. 8 are compared and a relationship established so that subsequent objective data can be converted into key preset instructions. Therefore, when new objective data (percentage coverage) information is obtained from the light table, that may be analyzed by breaking it down into its harmonic components, and by reference to the set of parameters m and b as represented by FIG. 9, the key set position is obtained by summing the predicted key position values obtained from each harmonic component.

Two computer programs are listed below. The first, C1, analyzes the information recorded in the press from the prior ten jobs and used that information to generate the parameters utilized by the second program, C2, which provides instructions for presetting the keys of the fountain in response to the information obtained from optically scanning a printing plate.

These programs are designed in Fortran as illustration of one to implement the procedures of this invention. This analysis may be made by an adapter circuit 100 shown in FIG. 6. All unexecutable statements, linkages, etc., which might obscure the source program understanding have been omitted. The following abbreviations will be used:

I=Fountains
J=Fourier components
K=Key numbers
L=Jobs
NK=Key values
NS=Normalized screen values.

The listed programs assume that all major information about key set points, KSETP (I,J), and the ink transfer functions ITRFN (I,J), for all twelve fountains (I=1,2, . . . 12) and all nine Fourier components (J=1,2, . . . 9), i.e. for the average, the zero harmonic and the sin and cos components of the first four harmonics) are saved in some common statement:

```
COMMON KSETP (12.9). ITRFN (13.9)
```

The retrieval of information for all ten jobs (L=1,2, . . . 10) saved in memory for all 24 Key numbers (K+1,2, . . . 24) for both the "normalized" screen values, NS(I,K), and the Keys, NK(I,K), can be made with a calling statement such as:

```
READ(L,*) NS(I,K), NK(I,K).
```

Program Ci, Analysis

```
DO 30, I=1,12
DO 30, J=1,9
X=XX=XY=Y=0
DO 20, L=1,10
SJ=KJ=0
DO 10, K=1,24
READ(L,*) NS(I,K), NK(I,K)
A=SIN( 360/24*INT(J/2.0)*(K-1+45*
(1+(-1)**(J+1)))*(1+(J#1))
SJ=SJ+NS(I,K)/65535/24*A
KJ=KJ+(4095-NK(I,K))/81.92/24*A
10 CONTINUE
X=X+SJ
XX=XX+SJ*SJ
XY=XY+SJ*KJ
Y=Y+KJ
20 CONTINUE
ITRFN(I,J) =(XY-Y/10)/(XX-X*X/10)
KSETP(I,J) =Y/10-ITRFN(I,J)*X/10
30 CONTINUE
END
```

Program C2, Control

```
DIMENSION S(9)
```

-continued

Program C2, Control

```
DO 30,I=1,12
DO 10, J=1,9
S(J)=0
DO 10,K=1,24
READ(L,*) NS(I,K)
S(J)=S(J)+NS(I,K)/65535/24*SIN(360/24*INT
(J/2.0)*(K-1)+45*(1+(-1)** 1*(J+1)))*(1+(J#1))
10 CONTINUE
DO 30, K=1,24
KJ=0
DO 20, J=1,9
KJ=KJ+(KSETP(I,J)+ITRFN(I,J)*S(J))*SIN
(360/24*INT(J/2.0)*(K-1)+45*(1+(-1)**(J+1)))
20 CONTINUE
NK(I,K)=4095-KJ*81.92
30 CONTINUE
END
```

While the method herein described constitutes a preferred embodiment of the invention, it is to be understood that the invention is not limited to this precise method and that changes may be made therein without departing from the scope of the invention which is defined in the appended claims.

What is claimed is:

1. A method of automatic control of a printing press comprising the steps of scanning a representation of an image to be printed to derive therefrom objective data representing the average density of the inked image in areas corresponding to those controlled by keys of an ink fountain, producing multiple printed copies of the image as a result of subjective operator intervention in the setting of the fountain keys, recording both the objective data and subjective data representing the setting of the fountain kyes as set by the operator for a plurality of different press runs, analyzing both the objective data and the key setting data by examining a plurality of harmonic components thereof sufficiently large to represent accurately that data, correlating by a linear regression analysis respective harmonic components of the objective data and subjective data over said plurality of press runs and storing said linear regression parameters, thereafter scanning a representation of a new image to be printed to derive objective data therefrom, analyzing the new objective data by examining its harmonic components, and by applying the regression parameter data for each previously found harmonic values, deriving therefrom key setting instructions for presetting the press.

* * * * *